United States Patent [19]

Petterson

[11] Patent Number: 4,984,288

[45] Date of Patent: Jan. 8, 1991

[54] LEAD REFILL CARTRIDGE FOR MECHANICAL PENCIL

[76] Inventor: Tor H. Petterson, 31248 Palos Verdes Dr. W., Rancho Palos Verdes, Calif. 90274

[21] Appl. No.: 362,516

[22] Filed: Jun. 7, 1989

[51] Int. Cl.[5] ..... B43K 19/14

[52] U.S. Cl. ..... 401/86; 221/267; 221/269; 206/443; 206/214

[58] Field of Search ..... 221/267, 269, 307; 401/89; 206/443

[56] References Cited

U.S. PATENT DOCUMENTS

| | | | |
|---|---|---|---|
| 1,461,146 | 7/1923 | Hey | 221/267 |
| 1,716,354 | 6/1929 | Nelson | 401/85 |
| 1,889,232 | 11/1932 | Ware | 221/269 X |
| 2,852,160 | 9/1958 | Danjczek | 221/267 X |
| 3,815,734 | 6/1974 | Kruckel | 206/443 |
| 4,240,759 | 12/1980 | Matsumoto | 401/85 |
| 4,352,581 | 10/1982 | Leuthold | 401/85 |
| 4,403,691 | 9/1983 | Kageyama | 401/89 |
| 4,603,990 | 8/1986 | Yamamoto | 401/85 |
| 4,659,242 | 4/1987 | Katz | 401/85 |
| 4,811,842 | 3/1989 | Sekiya | 206/443 |

FOREIGN PATENT DOCUMENTS

| | | |
|---|---|---|
| 61-140883 | 9/1986 | Japan . |
| 61-162492 | 10/1986 | Japan . |
| 62-28586 | 2/1987 | Japan . |

*Primary Examiner*—Richard J. Johnson

*Attorney, Agent, or Firm*—Edward A. Sokolski

[57] ABSTRACT

A cartridge for storing pencil leads and dispensing such leads into the lead storage chamber of a pencil has an assembly slidably mounted therein which has a dispensing spout on one end thereof. Pencil leads are contained within the cartridge and prevented from being released therefrom by a gate member formed on the slidable assembly. When the slidable assembly is actuated to effect slidable motion thereof relative to the main body of the cartridge, the gate member is driven out of the path between the leads and the dispensing spout, permitting the leads to be dispensed into the chamber of the pencil.

8 Claims, 4 Drawing Sheets

LEAD REFILL CARTRIDGE FOR MECHANICAL PENCIL

BACKGROUND OF THE INVENTION

1. Field of the Invention

This invention relates to refill cartridges for mechanical pencils and more particularly to such a cartridge which can be used for storing pencil leads and dispensing such leads directly into the storage chamber of a mechanical pencil.

2. Description of the Prior Art

Mechanical pencil lead is generally sold in containers from which the lead must be either removed individually for loading into the storage chamber of a mechanical pencil or poured into the chamber from such container. This loading operation is somewhat cumbersome and often results in broken and/or lost leads. Pat. No. 4,811,842 to Sekiya describes a pencil lead container designed to overcome this shortcoming. In this device, a vertically movable actuator is employed to open a gate or window in the top of the container while this same actuator drives a single pencil lead through the window and out of the container. While this device appears to overcome some of the shortcomings of the prior art mentioned above, it has certain shortcomings of its own. First, it is only capable of dispensing a single piece of lead with each actuation of its actuator. This makes the dispensing of lead into the pencil storage chamber somewhat time consuming and laborious. Further, the construction of the device of the Sekiya patent is somewhat more complicated and costly than to be desired in a throwaway type cartridge for packaging and vending lead.

SUMMARY OF THE INVENTION

The device of the present invention is a pencil lead cartridge having an opening at one end thereof which is adapted to matingly engage the opening of the lead storage chamber of a mechanical pencil. In the normal unactuated condition of the cartridge lead is prevented from passing through this opening by a blocking gate member. In the dispensing of lead into the pencil chamber, the gate is moved sidewise by a mechanical actuation to open the gate and permit all or as many of the pieces of lead in the cartridge as it may be desired to be fed into the pencil chamber.

It is therefore an object of this invention to facilitate the loading of pencil lead from a storage cartridge into the storage chamber of a pencil;

It is a further object of this invention to provide an improved pencil lead cartridge for use in storing and dispensing lead into the lead storage chamber of a pencil;

Other objects of the invertion will become apparent as the description proceeds in connection with the accompanying drawings of which:

DETAILED DESCRIPTION OF THE INVENTION

Figure 5:
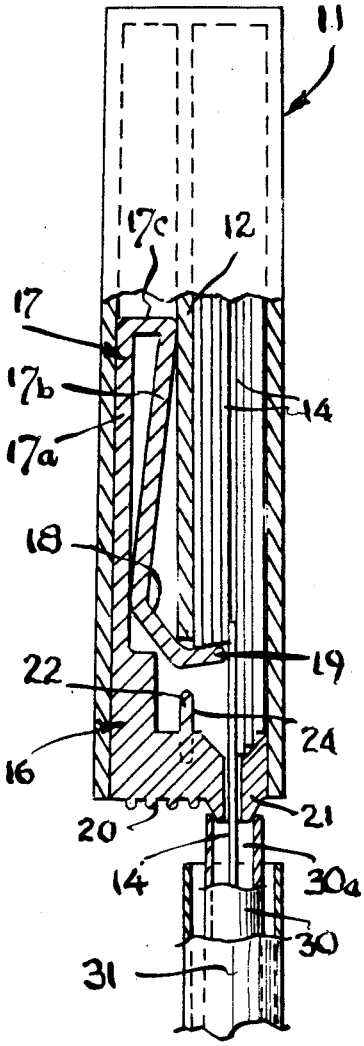
FIG. 5 is a cross sectional view in elevation of the preferred embodiment shown as being used to dispense leads into a pencil chamber.
Figure 3:
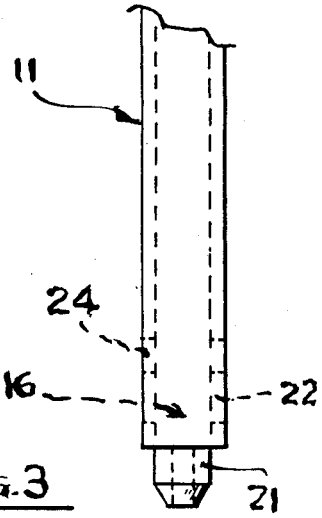
FIG. 3 is an end elevational view of the preferred embodiment with partial cutaway section.
Figure 4:
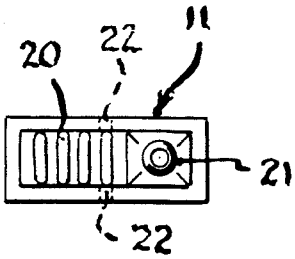
FIG. 4 is a bottom plan view of the preferred embodiment taken along the plane indicated by 4—4 in FIG. 1.

Referring now to FIGS. 1–5, a preferred embodiment of the invention is shown. Cartridge 11 which may be fabricated of a clear plastic material has a rectangular configuration. Septum 12 which is integrally formed with the main body portion of the cartridge and which runs substantially down the center thereof forms a chamber 13 in which pencil leads 14 are contained. Slidably mounted in the main body of cartridge 11 is assembly 16. This assembly has an elongated bifurcated arm member 17 formed by arm sections **17*a* and 17*b* which are elastically joined together by interconnecting cross arm 17*c* so that they normally are in the position shown in FIG. 2 but can be flexed towards each other as shown in FIG. 5. Assembly 16 further has a canted surface portion 18 which interconnects arm section 17*b* with a substantially lateral tab portion 19 which forms a gate for the leads. The very bottom portion of assembly 16 has an actuator knob 20 and a dispensing spout 21 formed therein. Assembly 16, is slidably retained in the main body portion of cartridge 11 by means of tabs 22 which extend from the opposite sides thereof and matingly fit in slots 24** formed in the side walls of the main body portion.

Figure 1:
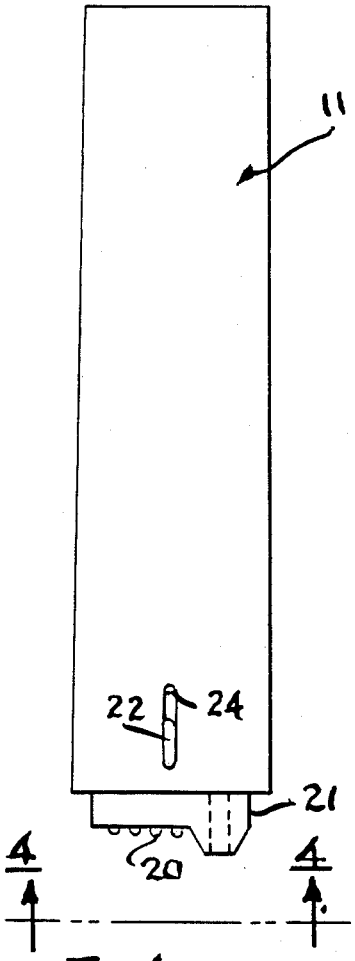
FIG. 1 is a side elevational view of a preferred embodiment of the invention.
Figure 2:
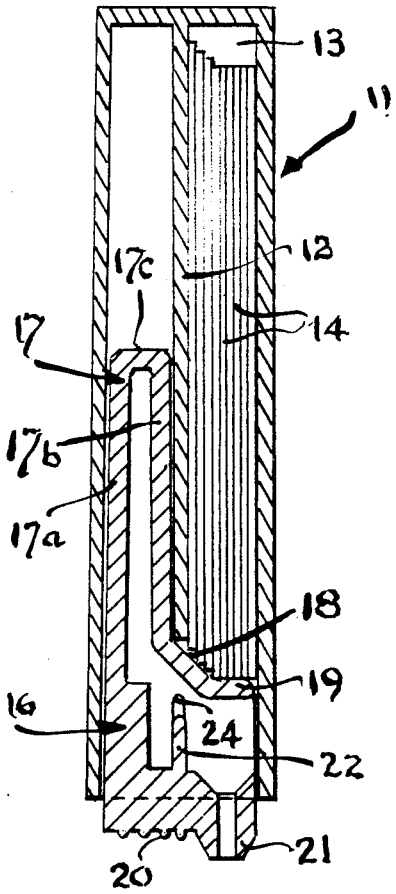
FIG. 2 is a cross sectional view in elevation of the preferred embodiment.

While being used for storage, as shown in FIG. 2, the leads 14 are retained in chamber 13, being prevented from exiting the chamber by gate portion 19 of assembly 16. In dispensing leads into the lead storage chamber 30 of pencil 31, spout 21 is placed into the opening **30*a* of the chamber with which it matingly engages. The spout may either be pushed downwardly against chamber 30 or actuator knob 20 may be pressed upwardly to drive arm 17 upwardly, as shown in FIG. 5. This causes canted surface 18 to be driven along septum 12 thereby driving arm section 17*b* towards arm section 17*a*. This in turn moves gate portion 19 laterally opening such gate to permit the passage of leads through spout 21 into chamber 30**.

Figure 6B:
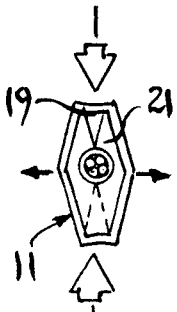
FIGS. 6, 6A, and 6B are schematic illustrations of a second embodiment of the invention.
Figure 6A:
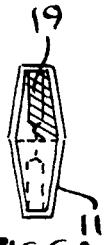
Figure 6:
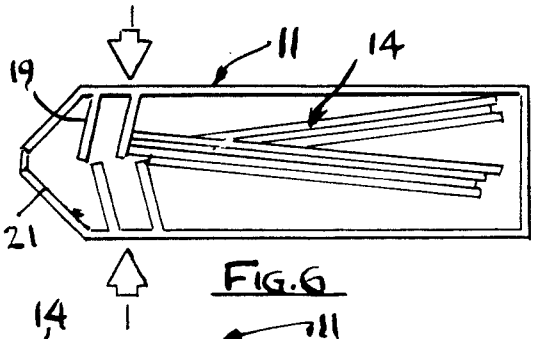

Referring now to FIGS. 6,6A, and 6B, a second embodiment of the invention is schematically illustrated.

In this embodiment, the cartridge 11 is made of a flexible material such as a suitable flexible plastic. With the cartridge in its normal condition, as shown in FIGS. 6 and 6A, the gate members 19 prevent the leads 14 from passing out of the cartridge. When the cartridge is squeezed, as shown in FIG. 6B, the gate members 19 are moved so as to permit the exit of leads from the cartridge.

Figure 7A:
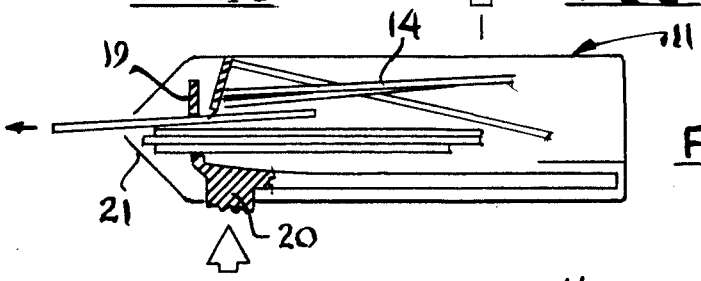
FIGS. 7 and 7A are schematic illustrations of a third embodiment of the invention.
Figure 7:
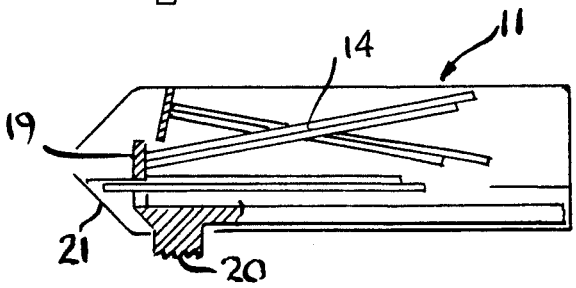

Referring now to FIGS. 7 and 7A, a third embodiment of the invention is shown. In this embodiment, the gate 19 is normally in the position indicated in FIG. 7. When the actuator knob 20 is pressed inwardly, as shown in FIG. 7A, the gate is opened and the leads 14 permitted to exit the cartridge.

Figure 8:
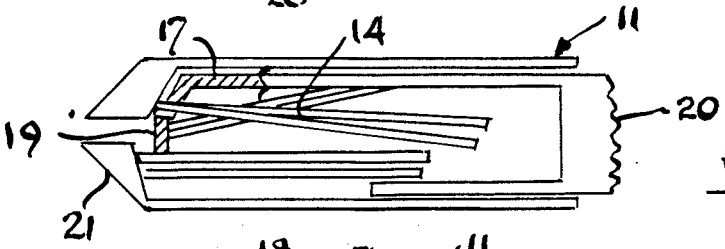
FIGS. 8 and 8A are schematic illustrations of a fourth embodiment of the invention.
Figure 8A:
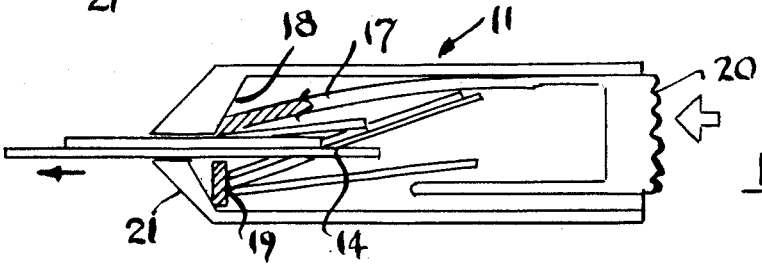

Referring now to FIGS. 8 and 8A, a fourth embodiment of the invention is shown. In this embodiment, gate 19 prevents the leads 14 from exiting the cartridge, as shown in FIG. 8. When actuator knob 20 is pushed forward, as shown in FIG. 8A, arm 17 rides along canted surface 18 and moves transversely until it reaches a position whereat the leads 14 are permitted to exit the cartridge.

Figure 9A:
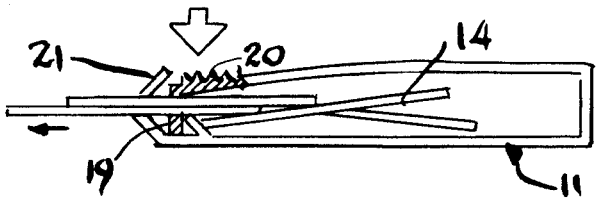
FIGS. 9 and 9A are schematic illustrations of a fifth embodiment of the invention.
Figure 9:
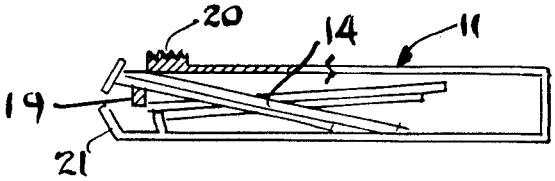

Referring now to FIGS. 9 and 9A, a fifth embodiment of the invention is shown. In this embodiment, the leads are prevented from exiting the cartridge by gate 19, as shown in FIG. 9. When knob actuator 20 is actuated, as shown in FIG. 9A, the gate is moved so as to permit the leads to exit the cartridge.

Figure 10:
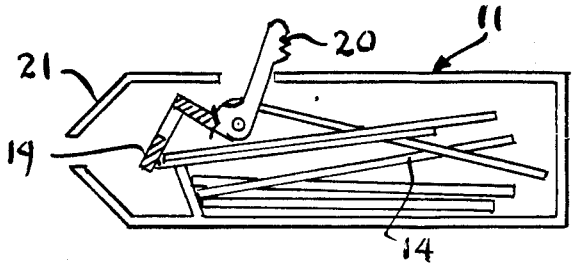
FIGS. 10 and 10A are schematic illustrations of a sixth embodiment of the invention.
Figure 10A:
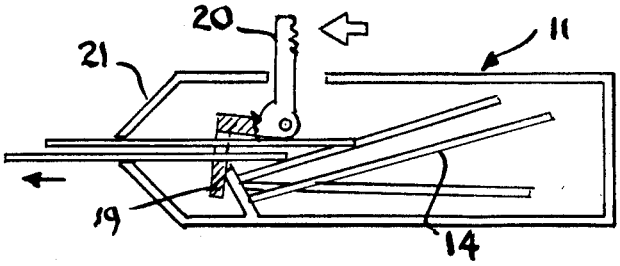

Referring now to FIGS. 10 and 10A, a sixth embodiment of the invention is shown. In this embodiment, the leads are prevented from exiting the cartridge by gate 19, as shown in FIG. 10. When actuator 20 is actuated, as shown in FIG. 10A, the gate is pivotally moved to open a passageway to permit the leads to exit the cartridge.

Figure 11:
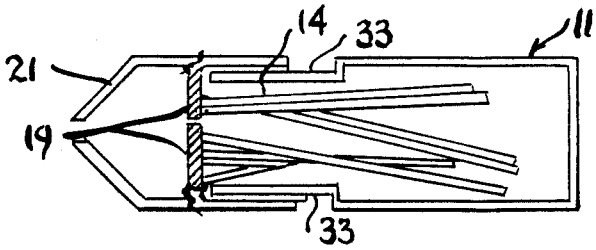
FIGS. 11 and 11A are schematic illustrations of a seventh embodiment of the invention.
Figure 11A:
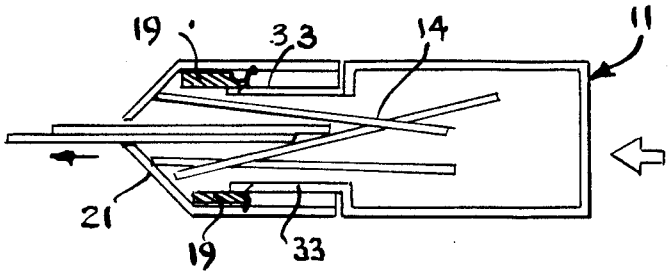

Referring now to FIGS. 11 and 11A, a seventh embodiment of the invention is shown. In this embodiment the leads 14 are kept from exiting the cartridge by gate members 19, as shown in FIG. 11. The spout portion 21 of the cartridge is slidably mounted on the main body portion of the cartridge. When the spout portion is pushed towards the main body portion in dispensing leads into a pencil chamber, this spout portion slides towards the main body portion of the cartridge and gate members 19 which are hinged to the spout portion are driven aside by fingers 33 to dispense the leads 14, as shown in FIG. 11A.

Figure 12A:
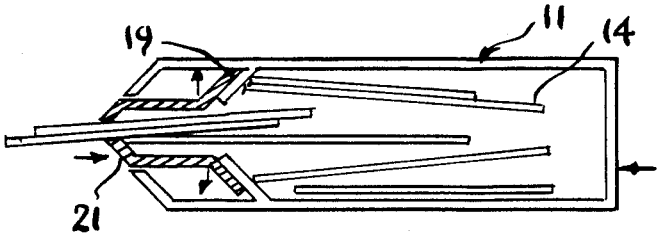
FIGS. 12 and 12A are schematic illustrations of an eighth embodiment of the invention.
Figure 12:
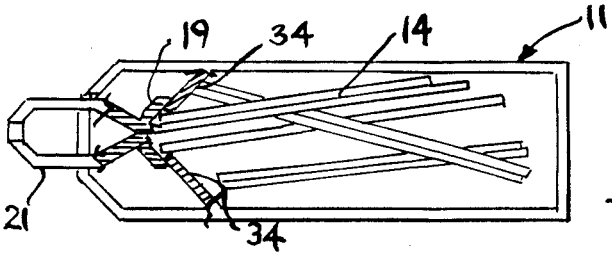

Referring now to FIGS. 12 and 12A, an eighth embodiment of the invention is shown. In this embodiment the leads are prevented from exiting cartridge 11 by gates 19, as shown in FIG. 12. When the cartridge is pushed against the inlet of the storage chamber of a pencil, arms 34 of the cartridge push on the slidably mounted spout portion 21, driving the gates open to dispense the leads, as shown in FIG. 12A.

Figure 13A:
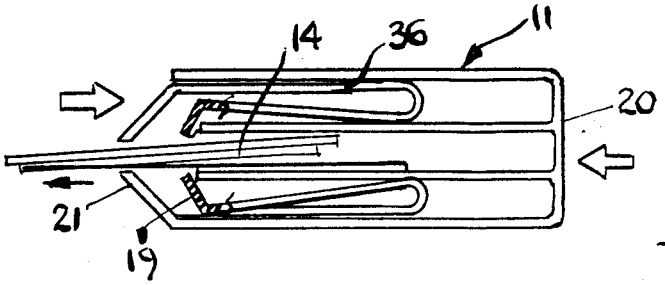
FIGS. 13 and 13A are schematic illustrations of a ninth embodiment of the invention.
Figure 13:
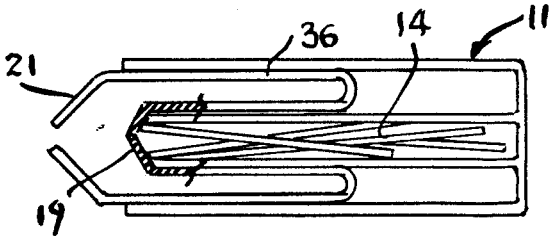

Referring now to FIGS. 13 and 13A, a ninth embodiment of the invention is shown. As shown in FIG. 13, gates 19 prevent the leads from exiting the cartridge. The spout portion 21 of the cartridge is integrated with a flexible web structure 36 which is slidably attached to the main body portion of cartridge 11. When the spout portion is pushed against the opening in the pencil storage chamber, the web structure operates to open gates 19 to release the leads, as shown in FIG. 13A.

Figure 14A:
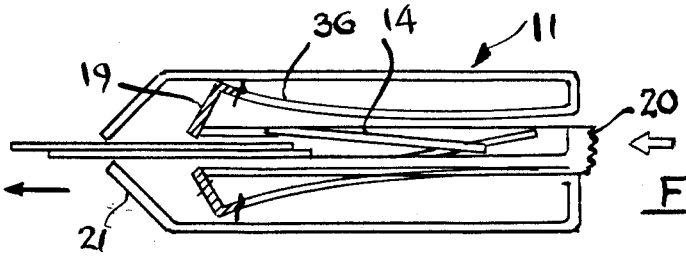
FIGS. 14 and 14A are schematic illustrations of a tenth embodiment of the invention.
Figure 14:
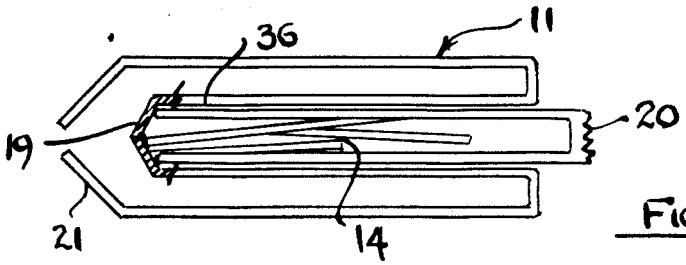

Referring now to FIGS. 14 and 14A, a tenth embodiment of the invention is shown. In this embodiment, the gates 19 are integrated with a flexible web structure 36 attached to the main body of cartridge 11. Actuator 20 has prongs which engage gates 19. With the cartridge unactuated, as shown in FIG. 14, the gates 19 remain closed, retaining the leads 14 in the cartridge. When the actuator 20 is depressed, the gates 19 are driven open through web structure 36 to dispense the leads, as shown in FIG. 14A.

Figure 15:
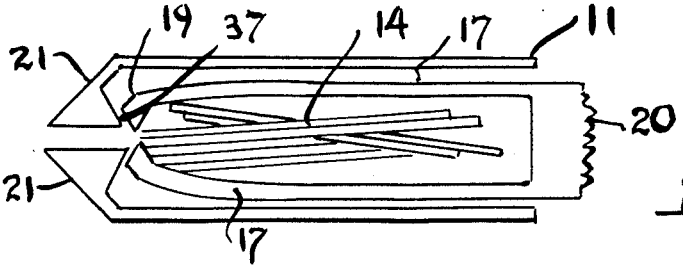
FIGS. 15 and 15A are schematic illustrations of an eleventh embodiment of the invention.
Figure 15A:
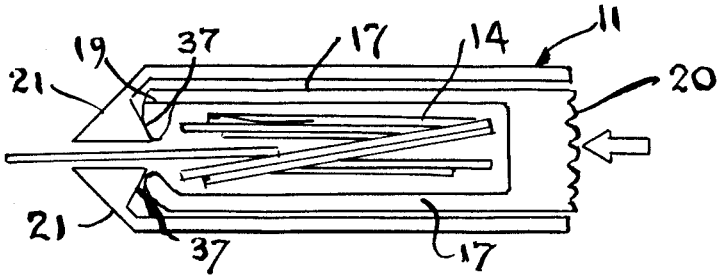

Referring now to FIGS. 15 and 15A, an eleventh embodiment of the invention is shown. In this embodiment, gates 19 are integrated with flexible arms 17. With the cartridge unactuated, as shown in FIG. 15, arms 17 are resiliently urged towards each other to keep gates 19 closed, &thus confining the leads 14 in the cartridge. With the actuation of actuator knob 20, as shown in FIG. 15A, gates 19 are driven against camming surfaces 37 which are formed in the main body portion of cartridge 11, thereby causing arms 17 to spread apart. The gates 19 are thus opened to permit the leads to exit the cartridge.

While the invention has been described and illustrated in detail, it is to be clearly understood that this is intended by way of illustration and example only and is not to be taken by way of limitation, the spirit and scope of the invention being limited only by the terms of the following claims.

I claim:

1. A cartridge for storing pencil leads and dispensing such leads in the lead storage chamber of a pencil comprising:

a main body portion having a chamber therein for storing pencil leads, an assembly, means for movably mounting said assembly in said main body portion, said assembly including:

dispensing means having an aperture formed therein for dispensing leads, said dispensing means comprising means for matingly engaging the lead storage chamber of the pencil, gate means positioned in a path between the chamber of said main body portion and said dispensing means aperture for preventing the pencil leads stored in said chamber from reaching said aperture, and means including said dispensing means for driving said gate means out of said path to permit said pencil leads to reach said aperture and to be dispensed from said dispensing means, said driving means being operated in response to downward force of said dispensing means against said pencil chamber, thereby causing motion of said assembly relative to the main body portion of said cartridge.

2. The cartridge of claim 1 wherein the dispensing means comprises a spout adapted to matingly engage the entrance to the lead storage chamber of said pencil, said gate being driven in response to downward force of said spout against said pencil chamber.

3. The cartridge of claim 1 and further including a pair of tabs extending laterally from opposite sides of said assembly, and slots formed in the main body portion of said cartridge in which said pair of tabs are slidably fitted.

4. The cartridge of claim 1 and further including an actuator knob for actuating said assembly slidably within said main body portion.

5. The cartridge of claim 1 wherein said driving means is operated in response to slidable motion of said assembly.

6. A cartridge for storing pencil leads and dispensing such leads into the lead storage chamber of a pencil comprising:

a main body portion having a chamber therein for storing pencil leads, an assembly slidably mounted in said main body portion, said assembly including:

dispensing means having an aperture formed therein for dispensing leads, gate means positioned in a path between the chamber of said main body portion and said dispensing means aperture for preventing the pencil leads stored in said chamber from reaching said aperture, and means for driving said gate means out of said path to permit said pencil leads to reach said aperture and to be dispensed from said dispensing means, said driving means being operated in response to slidable motion of said assembly relative to the main body portion of said cartridge and including an elongated bifurcated arm member having a pair of arm sections joined together by an elastic cross arm, said gate means comprising a tab formed on the free end of one of said arm sections and extending substantially laterally therefrom, a septum running down the main body portion of the cartridge, said arm member being located on one side of said septum, the other side of said septum forming the chamber for said pencil leads, said one of said arm members being driven laterally by said septum in response to said motion of said assembly.

7. The cartridge of claim 6 and further including a canted surface portion formed on said one of said arm sections immediately adjacent to said tab, said septum engaging the canted surface portion to drive said one of said arm sections.

8. A cartridge for storing pencil leads and dispensing such leads into the lead storage chamber of a pencil comprising:

chamber for storing pencil leads, dispensing means having an apertured portion formed therein for dispensing said leads, said apertured portion being adapted to matingly engage the opening of the lead storage chamber of the pencil, gate means positioned in a path between said chamber for storing pencil leads and said dispensing means apertured portion for preventing the pencil leads stored in said chamber from reaching said apertured portion, and means for driving said gate means out of said path to permit said pencil leads to reach said apertured portion to be dispensed therethrough into the storage chamber of the pencil, said driving means being operated in response to force applied between the apertured portion of said dispensing means and the opening of the storage chamber of the pencil.

* * * * *